US007096660B2

(12) United States Patent
Keady

(10) Patent No.: US 7,096,660 B2
(45) Date of Patent: Aug. 29, 2006

(54) PLASMA IMPULSE DEVICE

(76) Inventor: John P. Keady, 7351 Crestleigh Cir., Alexandria, VA (US) 22315

( * ) Notice: Subject to any disclaimer, the term of this patent is extended or adjusted under 35 U.S.C. 154(b) by 320 days.

(21) Appl. No.: 10/441,638

(22) Filed: May 20, 2003

(65) Prior Publication Data

US 2004/0070349 A1 Apr. 15, 2004

Related U.S. Application Data

(60) Provisional application No. 60/381,330, filed on May 20, 2002.

(51) Int. Cl.
*F03H 1/00* (2006.01)

(52) U.S. Cl. ..... 60/203.1; 60/204

(58) Field of Classification Search ..... 60/202, 60/203.1, 204; 315/111.41, 111.61
See application file for complete search history.

(56) References Cited

U.S. PATENT DOCUMENTS 3,155,858 A * 11/1964 Lary et al. ..... 60/202
4,014,168 A 3/1977 Carpenter
4,893,470 A 1/1990 Chang
4,930,394 A 6/1990 Zwingel et al.
6,040,547 A 3/2000 Antonova et al.
6,145,298 A 11/2000 Burton, Jr.
6,271,614 B1 8/2001 Arnold
6,334,302 B1 1/2002 Chang-Diaz
6,419,538 B1 7/2002 Diaz
6,449,941 B1 * 9/2002 Warboys et al. ..... 60/202
6,640,535 B1 11/2003 Gallimore et al.
6,644,014 B1 11/2003 Provitola
6,834,492 B1 * 12/2004 Hruby et al. ..... 60/202

* cited by examiner

*Primary Examiner*—Louis J. Casaregola

(57) ABSTRACT

A plasma impulse device/method has been developed to provide impulses that can be used for thrust. A field device produces electric and magnetic fields, which E×B drifts a charged portion in the ambient environment, resulting in thrust of the field device.

17 Claims, 6 Drawing Sheets

PLASMA IMPULSE DEVICE

BACKGROUND OF THE INVENTION

1. Field of the Invention

The present invention relates to a method, apparatus, and system for providing plasma impulses. More particularly it relates using plasma impulses to provide propulsion impulses.

2. Background Information

Atmospheric propulsion, where the ambient air is utilized as the propulsive medium, has many complications and desirable aspects. The aspects include near unlimited fuel (the ambient air is used) and few moving parts. The complications arise in deriving the conditions necessary for plasma motion before recombination, power consumption, and the field conditions necessary for sufficient thrust.

Using plasma instead of ambient air can provide plasma velocities in excess of what can be provided via chemical reactions. A rough estimate of the average temperature of a chemical reaction due to its temperature can be obtained by converting the temperature of the products into energy equivalents and solving for the velocity. The basic relationship between a Maxwellian plasma and temperature can be stated as:

$$E_{ave} = \frac{1}{2}mv_{ave}^2 = \frac{n_d}{2}KT \tag{1}$$

The constant $n_d$ is the number of dimensions, for example a strong magnetic field may effectively constrain the particles to travel in one direction so that $n_d=1$, or without a strong magnetic field the particle may be free to move in three dimensions so that $n_d=3$; "K" is the Boltzman constant $1.38\times10^{-23}$ J/° K, and "T" is the temperature in degrees Kelvin. For simplicity's sake only, if the chemical product is hydrogen with a mass of a proton of $1.67\times10^{-27}$ Kg at a temperature of 11600 K (Kelvin) the average one dimensional thermal velocity is:

$$\begin{aligned} v_{ave} &= \sqrt{\frac{n_d}{m}KT} \\ &= \sqrt{\frac{1}{1.67\times10^{-27}}(1.38\times10^{-23})(11600\text{ K})} \\ &\approx 9790\text{ m/s} \end{aligned} \tag{2}$$

Thus the velocity of a hydrogen chemical product at 11600K is roughly 9790 m/s. It should be noted that typical chemical reactions do not occur at such elevated temperatures, but plasma systems do.

In a plasma system, accelerated by the voltage difference of a simple 9 volt battery, the hydrogen plasma is accelerated by an Electric field across an equipotential difference of 9 volts and if one assumes that the hydrogen ion is singly ionized the acceleration of the ion can related to the potential difference as:

$$a = \frac{F}{m} = \frac{qE}{m} = \frac{-q(\phi_2 - \phi_1)}{md} \tag{3}$$

Where "a" is the acceleration; "F" is the force; "m" is the mass; "E" the electric field; "q" the charge ($1.6\times10^{-19}$ Coulomb); "d" the distance separating the 9 volt potential difference; and $\phi_2$ and $\phi_1$ are the potential differences at the end point (0 volt potential) and beginning point (9 volt potential) respectively. If the ion travels the complete distance between the potentials to acquire a 9 volt change the energy gained can be expressed as:

$$\begin{aligned} \Delta\varepsilon = \varepsilon_2 - \varepsilon_1 = Fd = -q(\phi_2 - \phi_1) &= -1.6\times10^{-19}(0-9) = 9\text{ eV} \\ &= 9(1.6\times10^{-19}\text{ J}) = 1.44\times10^{-18}\text{ J} \end{aligned} \tag{4}$$

Knowing the energy change and assuming an initial energy of 0, we can calculate the velocity of the hydrogen plasma as:

$$v = \sqrt{\frac{2\Delta\varepsilon}{m}} = \sqrt{\frac{2(1.44\times10^{-18}\text{ J})}{1.67\times10^{-27}\text{ Kg}}} = 41527\text{ m/s} \tag{5}$$

In the plasma example, a simple plasma potential difference of 9 volts can result in ion velocities roughly 4¼ times larger than a chemical combustion ion at 11600K. A 4¼ larger velocity represents an increase of 3¼ times the smaller velocity. This in turn represents roughly a 10½ increase in the energy.

When referring to plasma, what is meant is ionized atomic elements, molecules, or charged substances, to include fluids, solids, and gases. The common plasma instabilities are know to one of ordinary skill in the art of plasma physics.

Using plasma systems for propulsion in the ambient atmosphere presents several difficulties. Besides the difficulties of ionization, maintaining the ionized products long enough (recombination rate) to recognize the desired acceleration, applying sufficient electric and/or magnetic fields, acquiring a reasonable ion density, one has difficulties in using electric and magnetic fields to move the plasma without polarization fields developing.

E-Field Only Acceleration

FIGS. 1A–1C illustrate the difficulties associated with electric field acceleration of plasma; the development of polarization fields. FIG. 1A shows an ionized plasma 10 with charge neutrality (equal ions 20 and electrons 30) exposed to an external electric field 40. At first an external electric field 40 is applied to accelerate the ions 20 and electrons 30 (FIG. 1A). The ions 20 in the plasma 10 travel 60 in the direction of the external electric field 40, and the electrons 30 in the opposite direction 50, until charge builds up at either end of the plasma (FIG. 1B). The separation of the ions and electrons result in a polarization field 70, which opposes the external field 40 resulting in a net electric field 80 lower than the external electric field 40. The polarization field 70 continues to grow until the plasma 10 sees no net electric field 80 (FIG. 1C). The polarization field prohibits further acceleration of the plasma.

The rate of buildup of the polarization field depends on the mobility of the ions and electrons. If electrons gain 9 eV (an eV is an electron volt) to travel to one end of the plasma and ions gain the same, 9 eV, the electrons will buildup quicker than the ions. This results from a disparity in mass, hence although the energy gained is the same, the momentum change is different and thus, the electrons will have a larger velocity. More simply stated:

$$\varepsilon_+ = \varepsilon_- \tag{6}$$

$$\frac{1}{2}m_+v_+^2 = \frac{1}{2}m_-v_-^2 \tag{7}$$

$$\sqrt{\frac{m_+}{m_-}}\,v_+ = 42.86v_+ = v_- \tag{8}$$

Thus the time to set up the polarization field is determined by the mobility of the electrons.

One way to overcome the polarization effect is to separate the ions and electrons and accelerate each separately. For example in many ion thrusters, ions are produced and accelerated in electric fields. This works well but gradually net charge builds up on the thruster and, besides internal arcing, a polarization field develops. To avoid this most thrusters emit electrons to minimize or eliminate polarization effects.

E and B Field Accelerations and Plasma Drifts

In the study of fusion physics, plasma instabilities and drifts are well known by ordinarily skilled practitioners. Plasma instabilities and drifts are often undesirable and effort is made to eliminate them in fusion reactors. For example, in fusion physics the instabilities and drifts associated with the confined plasma lower the plasma density, decreasing the ability to maintain or achieve fusion. Drifts are essentially defined with respect to the magnetic field. There are drifts parallel to the magnetic field and drifts perpendicular. Drifts and instabilities can be derived by the fluid and Maxwell's equations.

Maxwell's equation in a medium are defined as:

$$\vec{\nabla}\cdot\vec{D} = \sigma \tag{9}$$

$$\vec{\nabla}\times\vec{E} = -\frac{\partial\vec{B}}{\partial t} \tag{10}$$

$$\vec{\nabla}\cdot\vec{B} = 0 \tag{11}$$

$$\vec{\nabla}\times\vec{H} = \vec{j} + \frac{\partial\vec{D}}{\partial t} \tag{12}$$

$$\vec{D} = \varepsilon\vec{E} \tag{13}$$

$$\vec{B} = \mu\vec{H} \tag{14}$$

These equations govern the relationship between electric and magnetic fields. The plasma reaction to the electric and magnetic fields can be expressed as a fluid equation of motion. The electron and ion equations of motion can be stated as:

$$mn\frac{d\vec{v}}{dt} = \pm en(\vec{E} + \vec{v}\times\vec{B}) - KT\vec{\nabla}n - mn\nu\vec{v} \tag{15}$$

This equation can be separated into the force parallel and perpendicular to the magnetic induction. The perpendicular equation is:

$$mn\frac{d\vec{v}_\perp}{dt} = \pm en(\vec{E}_\perp + \vec{v}_\perp\times\vec{B}) - KT\vec{\nabla}_\perp n - mn\nu\vec{v}_\perp \tag{16}$$

The parallel equation is:

$$mn\frac{d\vec{v}_{\|}}{dt} = \pm en(\vec{E}_{\|}) - KT\vec{\nabla}_{\|}n - mn\nu\vec{v}_{\|} \tag{17}$$

The first term in equation (16) is the force due to an Electric field. The second term is the Lorentz equation, the third term is the pressure term (electron density n), and the fourth term is the collisional term (collision frequency ν).

Notice that ions and electrons have different parallel forces when subjected to an Electric field alone and thus will separate creating a reducing polarization force (equation (17)). The pressure and collision terms slow down the rate of polarization.

The perpendicular motion equation can also result in the development of polarization electric fields. Several assumptions can be made when using equation (16). One assumption is that the collision frequency is large enough so that time derivative term is negligible, this can be viewed as the steady state situation. If collision frequencies are large enough so that the time-derivative can be neglected, then the particles are not trapped to rotate about the magnetic field, and particles can escape transverse to the magnetic field. This assumption for equation (16) gives the x-axis and y-axis equations as (assuming B lies in the z-axis):

$$mn\nu v_x = \pm enE_x - KT\frac{\partial n}{\partial x} \pm env_yB \tag{18}$$

$$mn\nu v_y = \pm enE_y - KT\frac{\partial n}{\partial y} \mp env_xB \tag{19}$$

The diffusion coefficient and the mobility coefficient can be defined respectfully as:

$$\mu \equiv |e|/m\nu \tag{20}$$

$$D \equiv KT/m\nu \tag{21}$$

These may be substituted into equations (18) and (19) and the velocity in the x-direction and the y-direction related as:

$$v_x = \pm\mu E_x - \frac{D}{n}\frac{\partial n}{\partial x} \pm \frac{\omega_c}{\nu}v_y \tag{22}$$

$$v_y = \pm\mu E_y - \frac{D}{n}\frac{\partial n}{\partial y} \mp \frac{\omega_c}{\nu}v_x \tag{23}$$

where $$\omega_c = \frac{eB}{m}$$

is the electron cyclotron frequency. Solving for $v_x$ and $v_y$, and letting $$\vec{v}_\perp = v_x\hat{i} + v_y\hat{j}, \quad \vec{E}_\perp = E_x\hat{i} + E_y\hat{j}, \quad \vec{\nabla}n = \frac{\partial n}{\partial x}\hat{i} + \frac{\partial n}{\partial y}\hat{j},$$

$$\mu_\perp = \frac{\mu}{1+\omega_c^2\tau^2}, \quad D_\perp = \frac{D}{1+\omega_c^2\tau^2}, \quad \text{and } \tau = \frac{1}{\nu}$$

(time between collisions), one may express the perpendicular velocity, to the magnetic field, as:

$$\vec{v}_\perp = \pm\mu_\perp\vec{E}_\perp - D_\perp\frac{\vec{\nabla}n}{n} + \frac{\vec{v}_E + \vec{v}_D}{1+(1/\tau^2\omega_c^2)} \tag{24}$$

where $\vec{v}_E$ is the E×B drift, the ion drift 140 and the negative drift 150 shown in FIG. 2A, for a uniform electric field 110, expressed as:

$$\vec{v}_E = \frac{\vec{E}_\perp \times \vec{B}}{B^2} \tag{25}$$

The ion 20 follows a spiral type path 120 resulting in the ion drift 140; likewise the electron or negatively charged particle 30, responding to the magnetic field 100 and the electric field 110, similarly follows a spiral path 130 resulting in the negative drift 150. Note that both drifts are equal in magnitude and in the same direction. The drifts, 140 and 150, when due to E×B, are the only drifts which are neither charge nor mass dependent. These drifts would be zero if the electric field was parallel to the magnetic field.

The pressure term also produces drifts 140 and 150 in response to the magnetic field 100 and a pressure gradient 200. The vector, $\vec{v}_D$, is the Diamagnetic drift causing the drifts 140 and 150 shown in FIG. 2B, for a uniform magnetic field, and can be expressed as:

$$\vec{v}_D = -\frac{\vec{\nabla}p \times \vec{B}}{qnB^2} \tag{26}$$

This drift would be zero if the gradient in the pressure was parallel to the magnetic field.

Notice from equation (24) that when the value $\omega_c^2\tau^2 >> 1$ the diffusion motion decreases, and that $$D_\perp \approx \frac{KT\nu}{m\omega_c^2}.$$

Essentially the magnetic field retards diffusion perpendicular. Likewise when $\omega_c^2\tau^2 << 2$ the magnetic field has little effect on diffusion. Notice that the diffusion term is independent of charge and thus both charges move in the same direction, however there is a mass dependence and hence electrons diffuse faster perpendicular. Thus, a polarization field 210 is set up slowing the diffusion.

When equation (24) was derived it was assumed that only an electric field perpendicular to the magnetic field was applied, but generally speaking a force transverse to a magnetic field will cause a charged particle to drift. The general expression is stated as:

$$\vec{v}_{Drift} = \frac{1}{q}\frac{\vec{F}\times\vec{B}}{B^2} \tag{27}$$

Hence gravity will exert a drift perpendicular to the magnetic field (replace F=mg 300) as shown in FIG. 2C. However, the gravity drift is charge dependent, thus polarization fields are established. This drift would be zero if the magnetic acceleration vector was parallel to the magnetic field.

A gradient magnetic field will also have a gradient force associated with it since the Lorentz force will have $qv\times(\vec{r}\cdot\vec{\nabla})\vec{B}$ term. FIG. 2D illustrates the gradient magnetic field drift. The ions and electrons drift in opposite directions resulting in a polarization current, which builds a polarization electric field. This drift would be zero if the gradient magnetic field was parallel to the magnetic field.

Other non-uniform magnetic field effects create drifts. FIG. 2E illustrates curvature drift. Curvature drift is the result of the force a particle feels when it attempts to remain parallel to the magnetic field line. The centrifugal force results in opposite drift for the ions and electrons orthogonally to the tangential direction of the magnetic field lines.

As discussed above, problems arise in the plasmasation of an ambient environment, and methods have been tried to avoid such an occurrence. In plasma thrusters, for use in space, the fuel is ionized but not the ambient environment, which by space's very nature fails to provide sufficient ambient environment for impulse purposes.

BRIEF DESCRIPTION OF THE DRAWINGS

The present invention will become more fully understood from the detailed description given herein below and the accompanying drawings, which are given by way of illustration only, and thus are not limitative of the present invention, and wherein.

DETAILED DESCRIPTION

The present invention is a method/apparatus/system for using plasma to impart an intentional impulse to a device. Wherein plasma is used to refer to a substance where, 1.) a portion of the substance has a positively charged subportion and a negatively charged subportion, or 2.) a portion of the substance has a positively charged subportion and there is no negatively charged subportion, or 3.) a portion of the substance has a negatively charged subportion and there is no positively charged subportion. Examples of plasma can be partially or fully ionized gas, electrons, ions, negatively charged atoms or molecules, partially or fully ionized liquids or solids, net charged liquids positive or negative, and other like substances.

One embodiment of the present invention uses a method, which provides a plasma impulse propulsion system for use in aircraft. For use in an aircraft system, the ion or plasma source in the plasma used can be carried separately or, more desirably, the ion source can be the ambient air. The question then becomes how to separate the air molecules into ions and electrons, accelerate them individually so as not to produce polarization fields, and how to do all of this within the recombination time after which there is no ion or electron to manipulate.

To maintain as simple a propulsion device as possible we will look to plasmasize the ambient air around the aircraft, and manipulate it remotely. Plasmasize is meant to refer to the creation of plasma as defined above. As we have discussed, isolated plasmas tend to form polarization fields when an external electric field is applied, which frustrates one's attempt to accelerate the plasma. What is desired is a plasma condition that affects ions and electrons alike, at the same velocity and the same direction (to avoid polarization effects).

Another, preferred embodiment, of the present invention, is a two dimensionally arranged device which manipulates a plasma in its surrounding environment to provide an intentional impulse to the device, which creates the magnetic and electric fields needed to create the impulse. The following example illustrates such methods and devices in accordance with the subject invention and describes methods of evaluating, manipulating and creating the plasma impulse.

Ia.) Plate Device Example for Illustrative Purposes

Figure 1A:
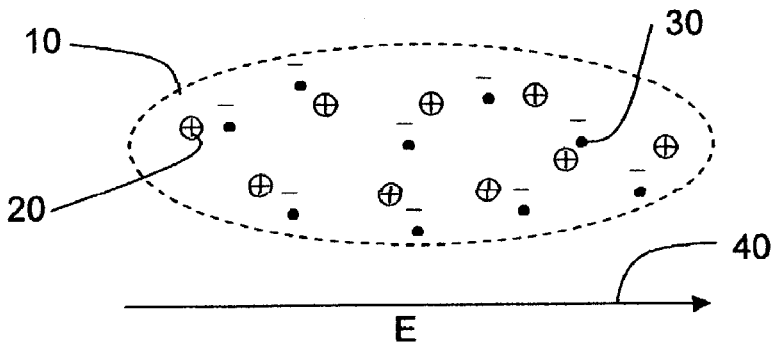
FIGS. 1A–1C illustrate background plasma physics processes but are not indicative of any particular prior art reference.
Figure 1B:
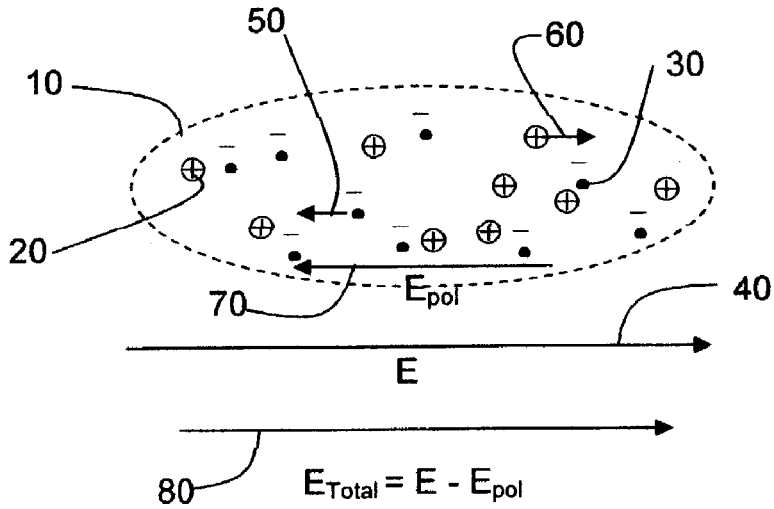
Figure 1C:
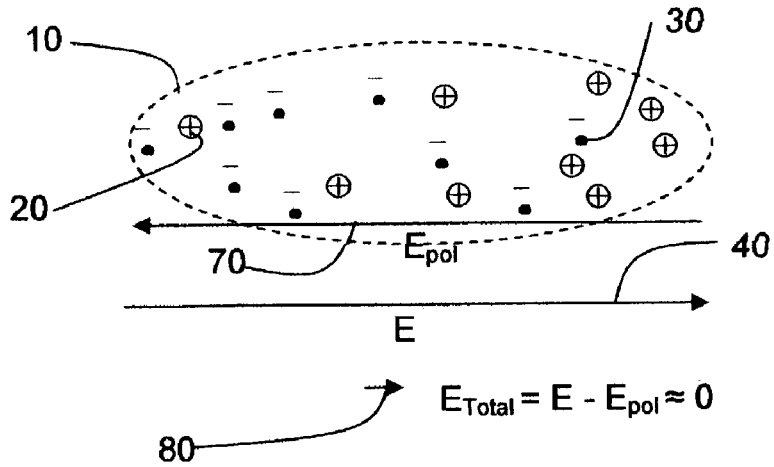
Figure 2A:
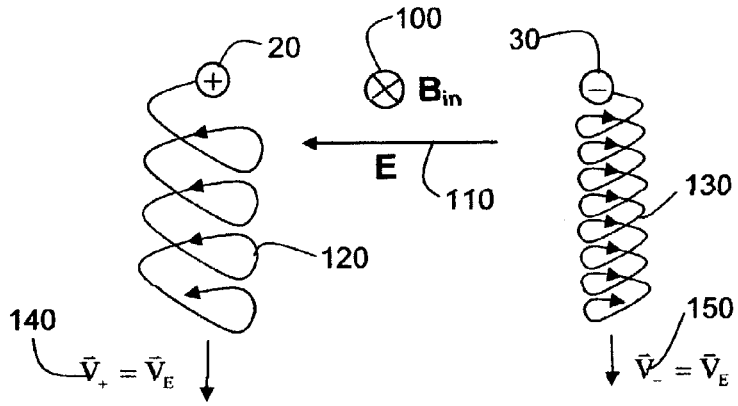
FIGS. 2A–2E illustrate background physic plasma drifts but are not indicative of any particular prior art reference.
Figure 2B:
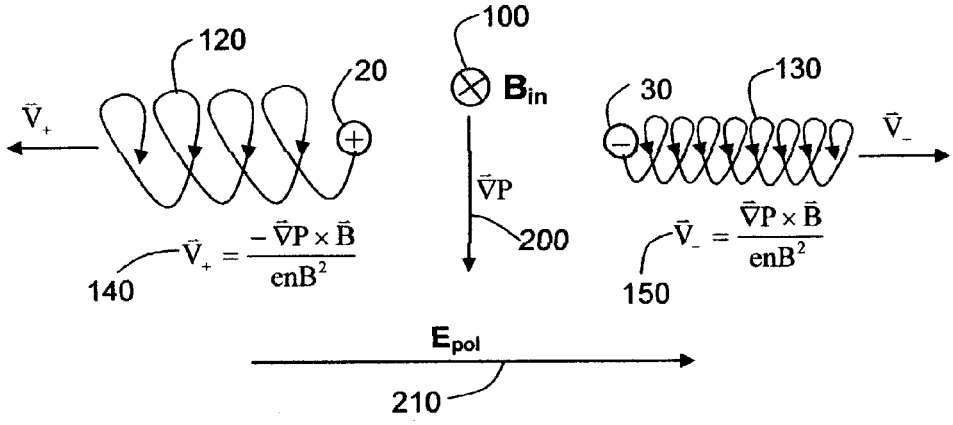
Figure 2C:
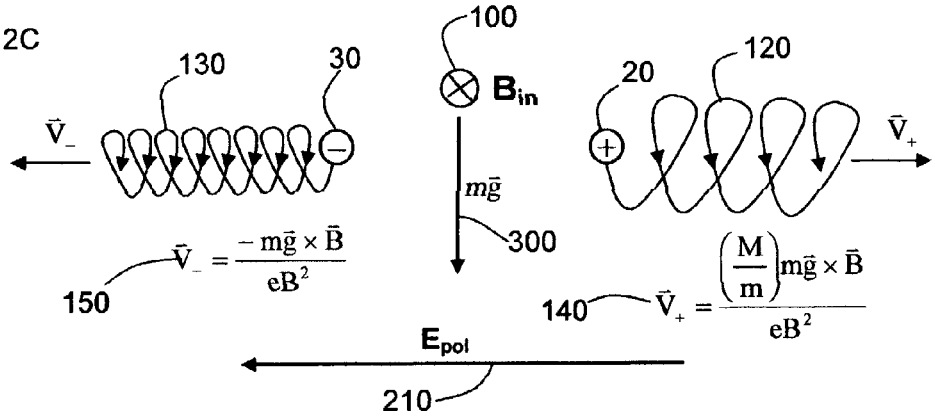
Figure 2D:
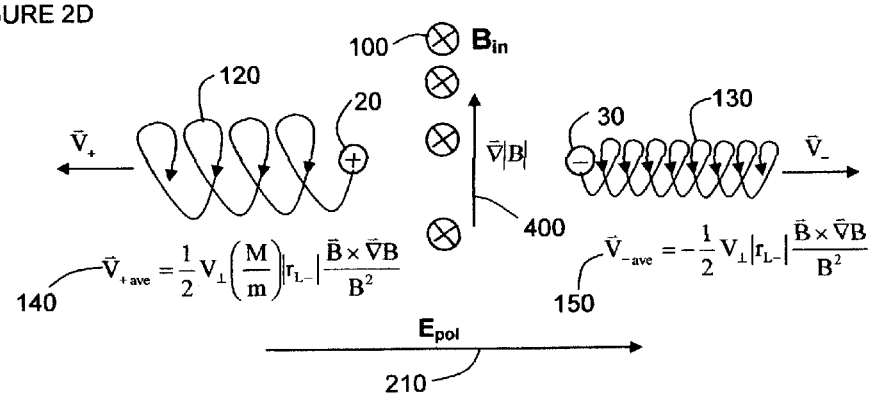
Figure 2E:
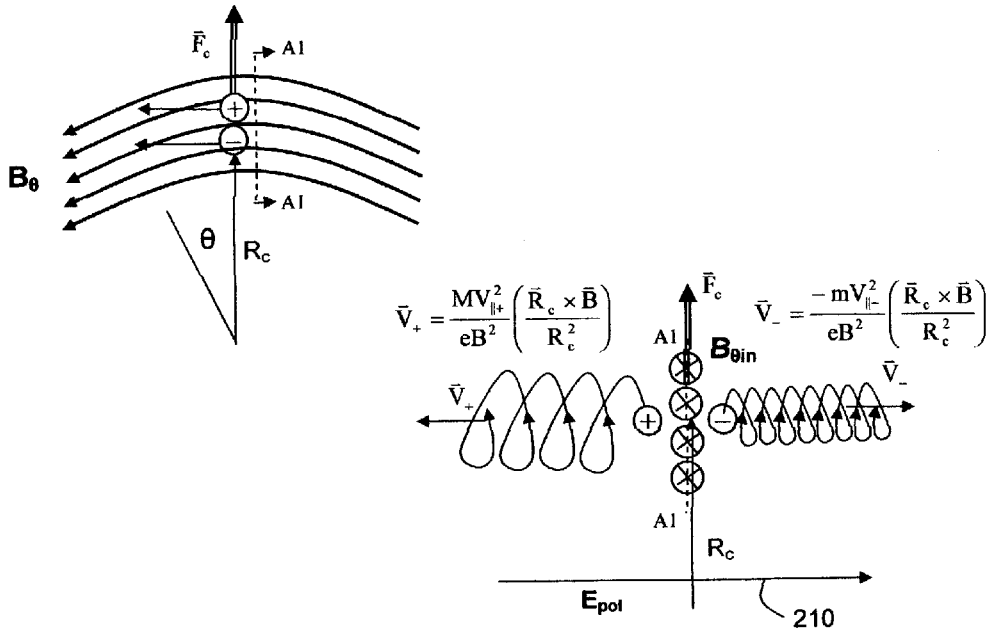
Figure 3:
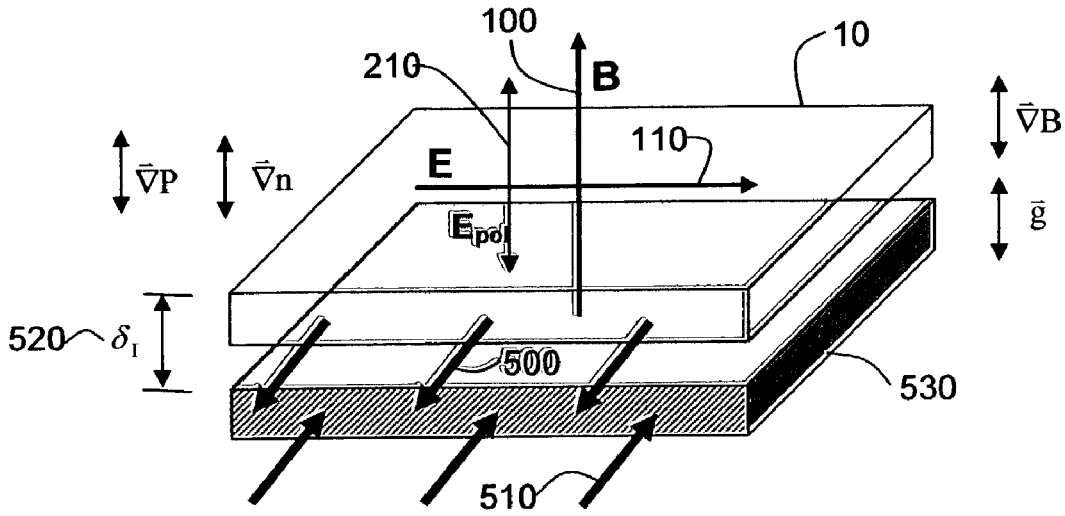
FIG. 3 Illustrates a preferred embodiment of a device in accordance with the subject invention for providing an intentional impulse by plasma drifts.

FIG. 3 illustrates a plate device 530 that has plasma 10 above it. The magnetic field 'B' 100 may be a vector toward or away from the surface of plate device 530. The desired direction of momentum 510 is imparted to the plate device 530 by a momentum change in the plasma 10 in a direction 500. Originally the plasma 10 was neutral ambient air at some energy (for example 0.026 eV). Although any ambient air energy would suffice as the use of 0.026 eV is for illustrative purposes for this example. The plasma 10 has been accelerated to drift velocities by the Electric and Magnetic fields. In the process the newly formed plasma 10 has gained energy from the fields and is now traveling at the E×B drift velocity. Other drift velocities can be used if the polarization field build-up is neutralized or minimized. The fields 100 and 110, in turn get their energy from the plate device 530, which generates the fields. The plate device 530 supplies the power necessary to maintain the fields via a power plant (not shown) but the change in momentum in the plasma 10 is generally transferred to the plate device 530 to conserve momentum. The plate can be a segment of a wing, or covering a substantial portion of the craft.

To understand the energy transfer it is easier to look at the conservation of energy between the now drifting plasma 10 and the plate device 530. Suppose the plate device has a mass, $M_{plate}$, and the plasma 10 has the mass, $M_{plasma}$. Then, conservation of energy gives:

$$\frac{1}{2}M_{plasma}V_{drift}^2 = Energy_{E,B,loss} + \frac{1}{2}M_{plate}\Delta V_{plate}^2 \tag{28}$$

The loss of energy in the fields 'Energy$_{E,B,loss}$' is typically expressed as Poynting's theorem:

$$\frac{-\partial}{\partial t}\int_v\left(\frac{1}{2}\varepsilon\vec{E}^2 + \frac{\vec{B}^2}{2\mu}\right)dt + \int_v \vec{J}_f\cdot\vec{E}dt + \oint_S(\vec{E}\times\vec{H})\cdot d\vec{a} \tag{29}$$

The difficulty with this equation is that it is derived from considering the energy dissipated into heat per unit volume, which is expressed as $\kappa = \vec{J}_f \cdot \vec{E}$. In the drift case there is no net current and thus there should be no net energy loss.

Ib.) One Method of Obtaining the Plasma Velocity Around the Plate Device

Another method to obtain the plasma velocity is to examine the energy gained from a plasma 10 at ambient temperature. Typically a molecule at room temperature has an energy of approximately 0.026 eV. We can assume that this is much less than the accelerated drift velocities, and so we assume that the plasma started as neutrals with approximately no initial velocity. Deriving the change in plate velocity due to the plasma drift we have:

$$\sqrt{\frac{M_{plasma}}{M_{plate}}}\,V_{drift} \approx \Delta V_{plate} \tag{30}$$

$M_{plasma}$ is the mass of the plasma that was accelerated from ambient temperature (assumed to be velocity=0 in this example, although any velocity can be used even one greater than the E×B drift velocity) to E×B drift velocity. There are several ways to look at this, one way is to look at the recombination time ($\tau$). The plasma being accelerated exists only for the time of existence of that plasma. Any plasma generated in a period of time defined by the recombination time can be accelerated to the E×B velocity. A newly formed plasma will be accelerated to the E×B velocity within one gyromotion since the E×B drift velocity is the drift of the guiding center. Hence, if the period of gyration $$\left(T_{g-} = \frac{2\pi}{\omega_{g-}} = \frac{2\pi m}{eB}, T_{g+} = \frac{2\pi}{\omega_{g+}} = \frac{2\pi m}{eB}\left(\frac{M}{m}\right)\right)$$

of the slowest particle, is less than the recombination time of that particle, then particle will reach, arguably, the average velocity of E×B drift. So we are left with three general conditions, condition 1, $\tau_{recombination} > T_{g-}$; condition 2, $\tau_{recombination} \approx T_{g-}$; and condition 3, $\tau_{recombination} < T_{g-}$.

Noe that the designed of any propulsion device can control which condition is applicable since the magnetic and electric fields are controllable variables. Hence there are three associated conditions for the magnetic field needed to set the desired condition. The associated magnetic field conditions are, $$\text{condition 1, } B > \left(\frac{2\pi m}{e\tau} = \frac{2\pi v_{recombination}}{e}\right); \tag{31}$$

$$\text{condition 2, } B \approx \left(\frac{2\pi m}{e\tau} = \frac{2\pi v_{recombination}}{e}\right); \tag{32}$$

$$\text{condition 3, } B < \left(\frac{2\pi m}{e\tau} = \frac{2\pi v_{recombination}}{e}\right). \tag{33}$$

If the recombination time is larger than the collision time, $\tau_{recombination} > \tau$, then the gyro-motion is disrupted and we need to look at the collision times. If collisions are dominant over recombination then equation (24) shows that the E×B drift is reduced by factor $$\left(1/1 + \frac{1}{\tau^2\omega_g^2}\right).$$

If one of the plasma particles is undergoing acceleration a collision will disrupt that acceleration. If we assume that a collision effectively disrupts the gyro-motion of the particle, then we should examine the collision frequency instead of the recombination time if we wish a complete gyro-motion to occur before disruption. The conditions on the magnetic field will have the same form but with the collision frequency (preferably the shortest time collision frequency with respect to the particle in question) will replace the recombination rate. We have then:

$$\text{condition 1, } B > \left(\frac{2\pi m}{e\tau} = \frac{2\pi v_{collision}}{e}\right); \tag{34}$$

$$\text{condition 2, } B \approx \left(\frac{2\pi m}{e\tau} = \frac{2\pi v_{collision}}{e}\right); \tag{35}$$

$$\text{condition 3, } B < \left(\frac{2\pi m}{e\tau} = \frac{2\pi v_{collision}}{e}\right). \tag{36}$$

To examine the final velocity of the generated plasma we look at the general acceleration equation as:

$$V_{final} = \left(\frac{V_{ExB} - V_{initial}}{T_{g\pm}}\right) \cdot T_{shortest} \tag{37}$$

$T_{shortest}$ is the shortest of the times $\tau$, $\tau_{recombination}$, or $T_{g\pm}$ where $T_{g\pm}$ is the gyro-period of the particular particle of question. This method or procedure can be used to obtain the general velocity of the plasma.

Ic.) Plasma Formation Above the Plate Device

For steady state plasma generation one can uset the continuity equation. The time varying continuity equation is:

$$\frac{\partial n}{\partial t} - D\nabla^2 n = S - L \tag{38}$$

'D' is the diffusion coefficient, 'S' is the source function, 'L' is the loss function, and 'n' is the plasma density. Note normally we consider the electron and ion densities to be equal $n_e = n_i$. However, this is not the case for ionization caused by electron impact, where the electrons are from an external source, thus equal charge density is not a limitation of the present device and/or method.

For the steady state condition equation (38) becomes:

$$\nabla^2 n = \frac{(S - L)}{D} \tag{39}$$

For the ionization of a plate, such as shown in FIG. 3, where the ionizing electrons are emitted from the surface of the plate, we have the general equation:

$$\frac{d^2 n}{d^2 s_{\|}} = -\frac{(S - L)}{D}\delta(0) \tag{40}$$

$\delta(0)$ is the delta function, and $s_{81}$ is distance from the plate's surface, in the parallel direction along the magnetic field line; the additional boundary condition is that the partial derivative in space become 0 at the source $$\frac{\partial^2 n}{\partial^2 s_{\|}} = 0.$$

The solution is of the form:

$$n = n_0\left(1 - \frac{|s_{\|}|}{\delta_I}\right) \tag{41}$$

$\delta_I$ is the maximum penetration depth of the ionizing electrons. $\delta_I$ is determined by the collisions of the ionizing electrons with the ambient gas, ions, and electrons, and '$n_0$' is the plasma density just above the plate. The source function 'S' is a function of the ionizing electron density $n_e$, which varies with depth above the plate. We assume for simplicity that the electron ionization density remains the same from the plate to $\delta_I$ this actually understates the density of ionizing electrons further away from the plate since upon the first ionization event the electron slows, when the electron slows density will build up in that region until the flow into a region equals that leaving. So this assumption understates the existing ionization.

One way of visualizing what is going on is to look at an individual ionizing electron with initial energy E_ and follow its path along the magnetic field line. An ionizing electron collides with electrons in a neutral. If the collision is of a certain energy there is a probability of an ionization event occurring. The frequency of the ionization event can be related to the ionization rate $K_{ionization}$, which is often measured in laboratory experiments. For example the formation of Oxygen Ions can undergo several chemical steps, the general equation for the formation of the ions relating the collision frequency ν, and the rate constant K is:

$$\nu = n_g K \tag{42}$$

'K' is the rate constant in ($cm^3/s$), '$n_g$' is the gas density. Although Oxygen is used throughout the examples presented herein, the present device and method are not limited to plasma formation in an Oxygen environment. Charge fluid plasma would additionally be applicable and the methods of evaluation would be similar with slight modifications taking into consideration density, ionization depth, or charge deposition depth or penetration. Additionally a plasma may be created inside the substance and not at the surface of the substance, for example a combination of beams can intersect within a substance and the intersection point achieve the desired conditions for ionization, which depends on the work functions of the substance.

For electron ionization of Oxygen, $O^2$, the general rates are expressed in Table 1, where $T_e$ is the electron temperature of the ionizing electron in Volts, and $T_{kelvin}$ is the ionizing electron temperature in Kelvins where 1 eV=11600K. The values in Table 1 assume an ionizing electron from 1 Volt to 7 Volts, we will use the rates shown in Table 1 generally for illustrative purposes outside this range, and the present method and devices according to the present invention are not limited to these ranges.

The general expression for the energy loss of an ionizing electron is:

$$E_(t) = E_0 - K_{Ionization} n_g t - K_{excitation} n_g t - K_{dissociation} n_g t - K_{momentum} n_g t \tag{43}$$

TABLE 1

| Rate Constants for $O^2$ | |
|---|---|
| (1) $e + O_2 \rightarrow \Delta momentum$ | $4.7 \times 10^{-8} T_e^{0.5}$ in ($cm^3/s$) |
| (2) $e + O_2 \rightarrow 2O + e$ | $4.2 \times 10^{-9} e^{(-5.6/T_e)}$ in ($cm^3/s$) |
| (3) $e + O_2 \rightarrow O + O^+ + 2e$ | $5.3 \times 10^{-10} T_e^{0.9} e^{(-20/T_e)}$ in ($cm^3/s$) |
| (4) $e + O_2 \rightarrow O_2^+ + 2e$ | $9.0 \times 10^{-10} T_e^{0.5} e^{(-12.6/T_e)}$ in ($cm^3/s$) |
| (5) $e + O \rightarrow O^+ + 2e$ | $9.0 \times 10^{-9} T_e^{0.7} e^{(-13.6/T_e)}$ in ($cm^3/s$) |
| (6) $e + O_2^+ \rightarrow 2O$ | $5.2 \times 10^{-9}/T_e$ in ($cm^3/s$) |
| (7) $O^+ + O_2 \rightarrow O + O_2^+$ | $2.0 \times 10^{-11} (300/T_{kelvin})^{0.5}$ in ($cm^3/s$) |
| (8) $e + O_2 \rightarrow O_2^* + 2e$ | $1.7 \times 10^{-9} e^{(-3.1/T_e)}$ |

Essentially an ionizing electron with initial Energy $E_0$ will loose energy over time as it ionizes, excites, transfers momentum, and dissociates. For the rates above the equation for energy loss of an electron from the surface of the plate is:

$$E_(t) = E_0 - t\left[\begin{array}{l}(K_{I(3)} n_{gO^2} \Delta E_{(3)}) - (K_{I(4)} n_{gO^2} \Delta E_{(4)}) - (K_{I(5)} n_{gO} \Delta E_{(5)}) - \\ (K_{e(8)} n_{gO^2} \Delta E_{(8)}) - (K_{d(2)} n_{gO^2} \Delta E_{(2)}) - (K_{m(1)} n_{gO^2} \Delta E_{(1)})\end{array}\right] = E_0 - \alpha t \tag{44}$$

Assuming that an electron is emitted from the plate, the penetration depth above the plate can be related can be determined by solving equation (44) for the case in which $$\alpha = \frac{E_0}{t_{\delta_I}}$$

$$\frac{E_0}{\alpha} = t_{\delta_I} \tag{45}$$

Although electron emission from the plate is used for ambient plasma formation, stimulation of the ambient environment to form plasma can be achieved by other methods meant to be incorporated in the present invention as equivalents. For example ultraviolet radiation can be focused and used to form plasma in ambient air, is such a case electrons would not have to be emitted from the surface of the plate.

Considering electron formation of plasmas, for example: assume that the electrons emitted from the surface used in plasma formation have an energy of 102 eV, although the present device is not limited to any plasma formation electron energy. To determine the time, $t_{\delta_I}$, we will consider the simply case of $O^{2+}$ ionization. A more complicated analysis should use equation (44). For $O^{2+}$ ionization with a 102 eV ionizing electron, the energy cost per ionization is roughly 12–17 eV, which includes dissociation, excitation, momentum transfer and ionization. To determine the penetration depth we can solve for the time using $K_{I(4)}$. The expression is using 17 eV:

$$\frac{E_0}{K_{1(4)} n_{gO^2} \Delta E_{ave}} = \frac{102\ \text{eV}}{9.0 \times 10^{-10} T_e^{0.5} e^{(-12.6/T_e)} (2.5 \times 10^{19}/\text{cm}^3)(17\ \text{eV})} \approx 3.0 \times 10^{-11}\,\text{sec} = t_{\delta_I} \tag{46}$$

Where '$n_{gO}{}^2$' is the number density at 1 Atmosphere (1 ATM). Note that with an initial energy of 102 eV an ionizing electron can ionize 6 neutrals. Using equation (46) the penetration depth can be expressed in relation to the average velocity of the ionizing electron (51 eV) as:

$$\delta_I = t_{\delta_I} V_{ave} = (3.0 \times 10^{-11}\,\text{sec})\left(\sqrt{\frac{2(51\ \text{eV}(1.6 \times 10^{-19}\text{J/eV}))}{9.11 \times 10^{-31}\text{Kg}}}\right) \approx 1.3 \times 10^{-4} m \tag{47}$$

Which essentially places the ionization region in the boundary layer of a plate with a fluid flowing above it.

To calculate the fields needed to create and appreciable thrust above a plate of area "A" we need to calculate the plasma density above the plate. To do this we again will look only at the simplified relationship in Table 1 of $O^{2+}$ ionization and $O^{2+}$ recombination. A more indepth analysis, using the interaction of the equations in Table 1, can be done for a more detailed analysis, which we leave for simple experimentation. Equation (4) and equation (6) of Table 1 can be equated for the steady state as:

$$\frac{dn_{e+O2\to 2e+O2+}}{dt} \approx \frac{dn_{e+O2+\to O2}}{dt} \tag{48}$$

$$n_e n_{O2} K_{I(4)} = n_e n_{O2+} K_{R(6)} \tag{49}$$

The ionized, $O_2^+$, and the original $O_2$ density of $2.5\times10^{19}/cm^3$ can be related as:

$$n_{O2}(t=0) = n_{O2}(t) + n_{O2+}(t) \tag{50}$$

$$2.5\times10^{19}/cm^3 = n_{O2} + n_{O2+} \tag{51}$$

Using equation (49) and (51) we can solve for the stability density of $O_{2+}$ plasma above the plate as:

$$n_{O2+\,(t)\,stability} = \left(\frac{K_{I(4)}}{K_{I(4)} + K_{R(6)}}\right) \times n_{O2}(t=0) \tag{52}$$

For this illustrative example of a plate device we assume an ionizing electron of average energy 51 eV(51 eV represents an ionizing electron that starts at 102 eV and ends at 0 eV), we have for the rates:

$$K_{I(4)} = 9.0\times10^{-10} T_e^{0.5} e^{(-12.6/T_e)} \approx 5.0\times10^{-9} (\text{cm}^3/\text{sec}) \tag{53}$$

$$K_{R(6)} = 5.2\times10^{-9}/T_e \approx 1.0\times10^{-10} (\text{cm}^3/\text{sec}) \tag{54}$$

$$n_{O2+\,(t)\,stability} = (50/51)\cdot 2.5\times10^{19}/\text{cm}^3 \approx 2.5\times10^{19}/\text{cm}^3 \tag{55}$$

We have assumed for simplicity that the other equations do not apply to be able to get a ballpark answer, but we can not assume that the plasma flow is zero. We want the plasma to be flowing according to the E×B drift. To further examine the thrust on a plate we must now include the motion of the plasma. We have already determined that the ionization layer is on the order of 0.1 mm for the illustrative example. If we have a plate of area "A" with width "w" and length "L" and we assume that the plasma E×B drifts parallel to the plate and the width direction, we can rewrite equation (49) as:

$$n_e n_{O2} K_{I(4)} = n_e n_{O2+} K_{R(6)} + 100 V_{E\times B} n_{O2+} L\delta_I \tag{56}$$

Equation (56) contains a plasma flow term, which represents the plasma flowing off of the plate and no longer susceptible to the applied electric and magnetic fields. The second term has a factor of 100, which converts the E×B drift velocity into cm/sec. For the sake of simplicity we will assume that the electron density is twice the ion density (an initial electron and a ionized electron), $n_e = 2n_{O2+}$. Combining equations (50) and (56) we have:

$$n_{O2+} = \left(\frac{K_{R(6)}}{K_{R(6)} + K_{I(4)}}\right)\left[n_{O2}(t=0) - \frac{50 V_{ExB} L\delta_I}{K_{I(4)}}\right] \tag{57}$$

Where $V_{E\times B}$ is the E×B drift and has a value $$V_{ExB} = \left|\frac{E}{B}\right|$$

where "E" is the electric field in Volts/meter, and B is the magnetic induction in Teslas; $V_{E\times B}$ is then in meters/sec.

2a.) Illustrative Example of E×B Thrust for a Plate in 1 Atm

FIG. 3 illustrates the general field and plasma orientation that we have discussed so far. In keeping with the prior sections we will assume that the values in Table 2 hold, although various values associated with gases, liquids, and solids are meant to lie within the subject matter of the present invention. The following invention being for illustrative purposes.

TABLE 2

| Example Values |
|---|
| Pressure = 1 ATM = 760 Torr |
| $n_g = n_{O2} = \eta(2.5\times10^{19}/\text{cm}^3)$ where η is a fraction of an atmosphere |
| $K_{coll(I)} \approx 4.7\times10^{-7}$ cm³/sec |
| $K_{I(4)} \approx 5.0\times10^{-9}$ cm³/sec from Table 1 |
| $K_{R(6)} \approx 1.0\times10^{-10}$ cm³/sec from Table 1 |
| E = 10000 Volts/meter |
| B = 1.0 Tesla |
| L = 1.0 cm |
| A = 1 cm² |
| E_(t = 0) = 102 eV |
| $V^{acceptable}_{ExB} = \gamma V_{ExB} = 1.0\times10^{-4}\ V_{ExB}$ |

The thrust for a 1 cm² plate can be solved in a series of steps. As we have stated the strength of the generated magnetic field determines where in the atmosphere a vehicle using this propulsion system can operate. The factor η can be solved to obtain the fraction atmospheres that the particular B-field strength will allow operation at the acceptable $V_{E\times B}$. The relationship is:

$$\gamma \equiv \left(1 + \frac{1}{\tau^2\omega_g^2}\right) = \left(1 + \frac{\nu_{coll}^2}{\omega_g^2}\right) = \left(1 + \frac{n_{O2}^2 \eta^2 K_{c(1)}^2 m_{ion}^2}{q^2 B^2}\right) \tag{58}$$

Therefore, the fractional atmosphere may be solved as:

$$\eta = \frac{qB(\gamma-1)^{1/2}}{n_{O2}^{1ATM} K_{C(1)} m_{O2+}} \tag{59}$$

Given the values in Table 2 we can solve equation (59) to obtain the fractional atmosphere that a magnetic field strength of 1 Tesla will give us the desired E×B drift velocity. Using the values in Table 2 we obtain, $\eta \approx 5.1\times10^{-5}$, or $n_{O2}(t=0) \approx 1.27\times10^{15}/\text{cm}^3$. We can now calculate the time of ionizing electron penetration $t_{\delta_I}$.

$$\frac{E_0}{K_{I(4)}n_{gO^2}\Delta E_{ave}} = \frac{102\text{ eV}}{(5.0\times10^{-9}\text{ cm}^3/\text{sec})(1.27\times10^{15}/\text{cm}^3)(17\text{ eV})} \approx 9.45\times10^{-7}\text{ sec} = t_{\delta_I} \tag{60}$$

$$\delta_I = t_{\delta_I}V_{ave} = (9.45\times10^{-7}\text{ sec})\left(\sqrt{\frac{2(51\text{ eV}(1.6\times10^{-19}\text{ J/eV}))}{9.11\times10^{-31}\text{ Kg}}}\right) \approx 4\text{ m} \tag{61}$$

As we can see at higher altitudes the penetration depth is larger. We assume here that the Electric and magnetic fields penetrate the 4 meters, although the Electric field will in actuality decrease by a factor of 9. We can now solve for the stable ion density as:

$$\begin{aligned} n_{O2+} &= \left(\frac{K_{R(6)}}{K_{R(6)}+K_{I(4)}}\right)\left[n_{O2}(t=0) - \frac{50V_{ExB}L\delta_I}{K_{I(4)}}\right] \\ &= \left(\frac{50}{51}\right)\left[1.27\times10^{15}/\text{cm}^3 - \frac{50(1)4}{5\times10^{-9}}\Big/\text{cm}^3\right] \\ &= 1.245\times10^{15}/\text{cm}^3 \end{aligned} \tag{62}$$

Now we may calculate the delta V imparted to the 1 $cm^2$ plate. Assuming a plate mass of 10 grams and using equation (30) we have:

$$\begin{aligned} \sqrt{\frac{M_{plasma}}{M_{plate}}}\,V_{drift} &\approx \Delta V_{plate} \\ &\approx \sqrt{\frac{A\delta_I n_{o2+}16(1.67\times10^{-27})}{1.0\times10^{-2}}}\ 1\text{ m/sec} \\ &\approx 1.15\times10^{-3}\text{ m/sec} \end{aligned} \tag{63}$$

Suppose we wish to have a $\Delta V_{plate} \approx \Delta V_{vehicle} \approx 1.0\times10^4$ m/sec for a 10,000 Kg vehicle, what area is needed? We can rearrange equation (63) to solve for the area needed. The expression is:

$$\begin{aligned} A &= \left(\frac{M_{vehicle}\Delta V^2_{vehicle}}{\delta_I n_{O2+}m_{O2+}}\right)\left(\frac{\gamma}{V_{ExB}}\right)^2 \\ &\approx \left(\frac{10000(1.0\times10^4)^2}{4(1.245\times10^{15})16(1.67\times10^{-27})}\right)(1)^2 \end{aligned} \tag{64}$$

Giving an area of $A=7.5\times10^{17}$ $m^2$. The area can be decreased with increasing magnetic field.

Figure 4:
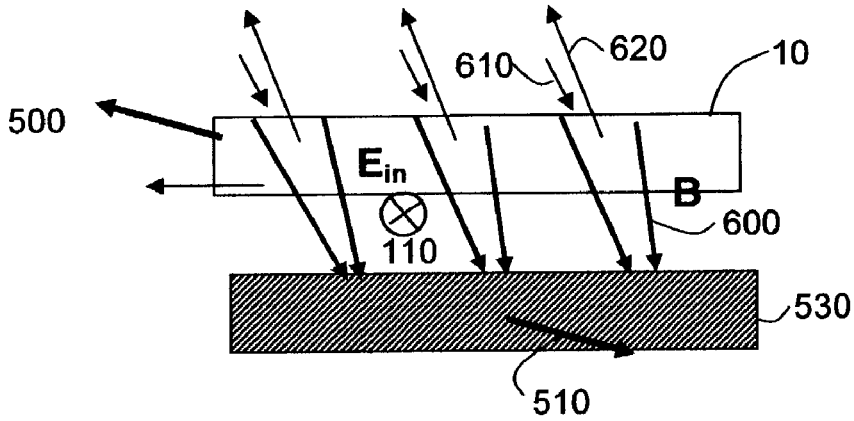
FIG. 4 shows a cross section view of FIG. 3.

FIG. 4 illustrates a cross-section of the plate device of the preceding illustrative example. An electric field 110 and magnetic field 600 are generated by the plate, for example by conductive strips across the plate at various voltages for the Electric field 110, and coils or permanent magnets for the magnetic field 600. The magnetic fields 600 can be of varying strength near the plate resulting in mirror forces causing plasma reflection motions 610 and 620 in the plasma 10 resulting in a net plasma motion 500 not parallel with the plate device 530 creating a non parallel motion of the plate device 510.

Figure 5:
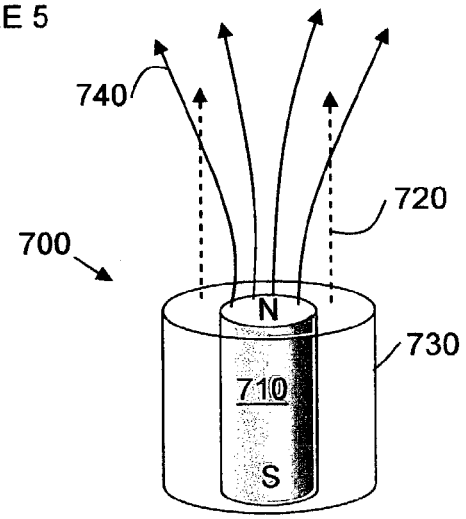
FIG. 5 illustrates one embodiment in accordance with the subject invention for providing magnetic fields and an ionization mechanism.

FIG. 5 illustrates one embodiment 700 in accordance with the subject invention for providing magnetic fields 740 and an ionization mechanism 720. Plasma producing electrons or light are emitted from the peripheral of a magnetic field source 710, which may be of micro machined size. The magnetic field source can be a permanent magnetic (to include super conductivity magnets cooled radiatively or with coolant, not shown), a coil with a current or a combination of both.

Figure 6:
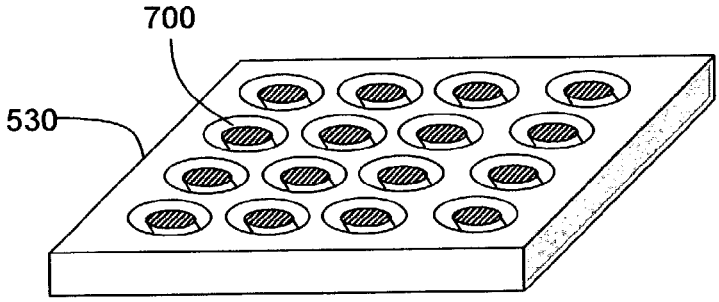
FIG. 6 illustrates yet another embodiment in accordance with the subject invention wherein the device illustrated in FIG. 5 is arranged in a predetermined arrangement.

FIG. 6 illustrates yet another embodiment in accordance with the subject invention creating a plate device 530 wherein the device illustrated in FIG. 5 is arranged in a predetermined arrangement. Not shown is a potential difference between the ends of the plate creating an electric field. The electric field can be move to vary the direction of the plasma motion. The electric field can be created via conductive strips at varying relative potentials.

Figure 7:
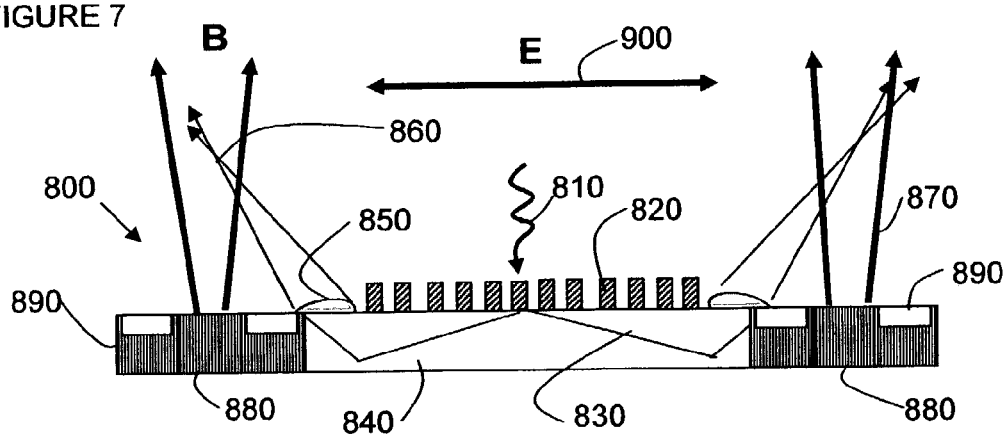
FIG. 7 illustrates a cross section of a device in accordance with the subject invention where magnetic fields, electric fields, ionization, and plasma drifts result in an intentional impulse where an external light source is utilized in the ionization mechanism.

FIG. 7 illustrates a cross section of a device 800 in accordance with the subject invention where magnetic fields 870, electric fields 900, plasma formation regions 860, result in plasma drifts creating an intentional impulse where an external light source 820 is utilized in the ionization mechanism. The external light source could be a remote laser or other source such as natural ultraviolet light which enters the device 800, possible through reflection inhibiting structures 820 (on the order of the incident light wavelength). The light 810 entering the device is channeled via the property differences between section 830 and 840, for example index of refraction difference or a reflective coating at the interface of section 830 and 840, to a collimating lens 850, which may be of micro-size. The collimating lens could be removed if the section 830 has varying index of refraction properties that effectively achieve the same result. Likewise the reflective inhibiting structure 820 can be removed as well provided the absorption of the incident light radiation is sufficient for the plasma formation process. The electric fields are produced by potential differences between conductive regions 890 and the magnetic fields are produced by magnetic field sources 880.

Figure 8:
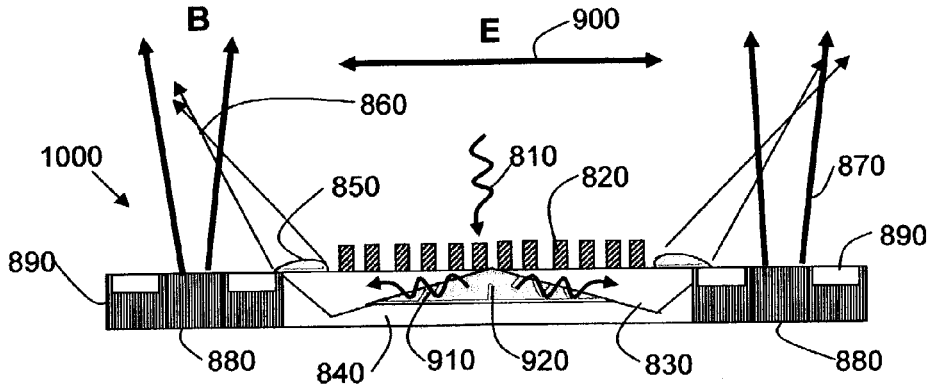
FIG. 8 illustrates a cross section of a device in accordance with the subject invention where magnetic fields, electric fields, ionization, and plasma drifts result in an intentional impulse where an external and internal light source is utilized in the ionization mechanism.

FIG. 8 illustrates a cross section of a device 1000 in accordance with the subject invention similar to that shown in FIG. 7 but with an internal light radiation 910 source 920. As in FIG. 7 the radiation is focused in a plasma formation region 860, wherein the intensity and energy is sufficient to create the needed plasma density, calculated using methods similar to those described above with respect to the illustrative example.

Figure 9:
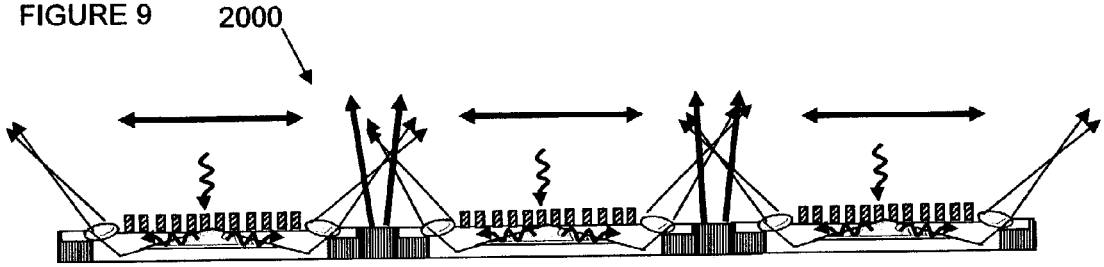
FIG. 9 illustrates yet another embodiment in accordance with the subject invention wherein the system of FIG. 9 is arranged in a predetermined arrangement.

FIG. 9 illustrates yet another embodiment in accordance with the subject invention wherein the system of FIG. 9 is arranged in a predetermined arrangement forming a plate device. It should be noted that the present invention is not limited to a two-dimensional plate form. Various curved surfaces can be used, for example the skin of an aircraft could form the plasma impulse device, or the skin of a submarine. The shape is not intended to be limitative of the invention but only illustrative.

Figure 10:
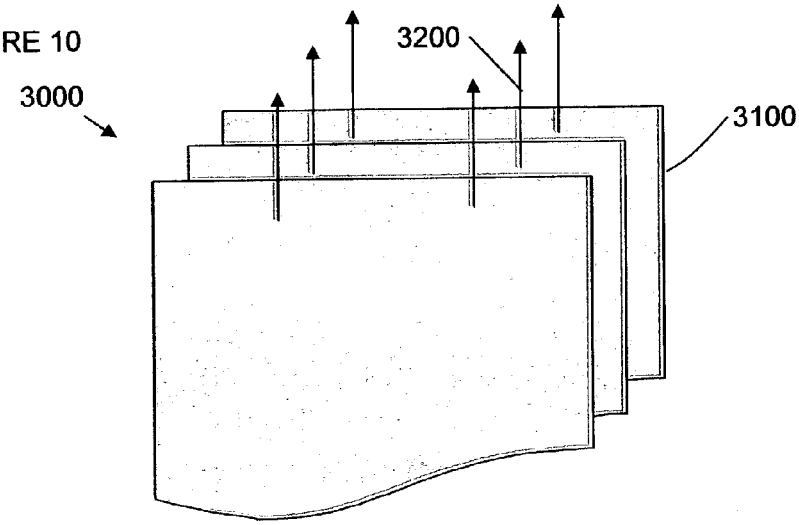
FIG. 10 illustrates a device in accordance with the subject invention wherein a system similar to that illustrated in FIG. 9 is arranged in layers to increase the surface area, providing a method of providing required ionization surface requirements.

FIG. 10 illustrates a device 300 in accordance with the subject invention wherein a plate device system similar to that illustrated in the above discussions is arranged in layers to increase the surface area, providing a method of providing the desired surface requirements. Such an arrangement can be used to create an engine without using the skin of the vehicle.

Many variations in the design of incorporating using E×B drifting of plasmas to provide an intentional impulse may be realized in accordance with the present invention. It will be obvious to one of ordinary skill in the arts to vary the invention thus described. Such variations are not to be regarded as departures from the spirit and scope of the invention, and all such modifications as would be obvious to one skilled in the art are intended to be included within the scope of the following claims.

I claim:

1. An impulse system comprising:

A field device, wherein said field device projects magnetic and electric fields into a reactive region, wherein a medium surrounds said field device, where the reactive region has a charged portion, where the electric and magnetic fields are at predetermined vector angles with respect to each other in the reactive region, and produce an E×B drift in a portion of the charged portion creating an impulse on said field device, moving said field device.

2. The impulse system of claim 1, wherein the charged portion in the reactive region is a plasma produced by a plasma producing device.

3. An impulse system according to claim 1, wherein said field device comprises:

a surface;

coils, wherein said coils are embedded in said surface, and said coils produce the magnetic field when currents run through said coils; and conductive strips, wherein potential differences are created across said strips to produce the electric field.

4. An impulse system according to claim 1, wherein said field device comprises:

a surface;

permanent magnets, wherein said magnets are embedded in said surface, and said magnets produce the magnetic field; and conductive strips, wherein potential differences are created across said strips to produce the electric field.

5. An impulse system according to claim 2, wherein said plasma producing device comprises:

a surface, where radiation enters said surface and is reemitted into the reactive region creating the plasma.

6. An impulse system according to claim 2, wherein said plasma producing device comprises:

a surface; and an internal radiation source, wherein said internal radiation source produces radiation that is emitted into the reactive region creating the plasma.

7. A method of moving a field device comprising:

generating electric and magnetic fields in a reactive region in a medium, where the medium surrounds a field device, where the field device generates the electric and magnetic fields, and where the electric and magnetic fields are at predetermined vector angles with respect to each other in the reactive region;

generating a charged region in the reactive region; and

E×B drifting a portion of the charged region using said magnetic and electric fields, the E×B drift creating an impulse on the field device, moving the field device.

8. A plasma impulse system comprising:

a field producing means, wherein said field producing means projects magnetic and electric fields into a reactive region in a medium surrounding said field device, where the electric and magnetic fields are at predetermined vector angles with respect to each other in the reactive region; and a plasma producing means, wherein said plasma producing means produces a plasma in the reactive region, where the electric and magnetic fields result in an E×B drift of a portion of the plasma, and where E×B drift of the portion creates an impulse on said field producing means moving said field device.

9. The impulse system according to claim 2, wherein the plasma is a net neutral plasma.

10. The impulse system according to claim 2, wherein the predetermined vector angle is about 90 degrees.

11. The impulse system according to claim 2, wherein the medium is air.

12. The impulse system according to claim 2, wherein the medium surrounds said field device by surrounding a vehicle that contains the field device.

13. The impulse system according to claim 12, wherein the medium is a vacuum, and the charged portion is ionized gas, wherein the gas is stored in tanks aboard the vehicle.

14. The impulse system according to claim 2, wherein the plasma producing device comprises:

a surface, wherein electrons are emitted from the surface into the reactive region, wherein at least one of the electrons has an energy greater than or equal to the ionization energy of neutral atoms in the reactive region.

15. The impulse system according to claim 5, wherein the radiation enters a portion of the surface via a feature region, wherein the feature region includes a plurality of features that have a dimension smaller than a wavelength of the radiation, wherein once the radiation enters it is redirected to a focusing element that focuses at least a portion of the radiation into the reactive region ionizing at least a portion of neutral gas forming the plasma.

16. A propulsive unit comprising:

a plurality of impulse systems according to claim 1, wherein the plurality of surfaces associated with the plurality of impulse systems are substantially parallel.

17. The impulse system according to claim 1, wherein the charged portion is generated from a portion of the medium.

* * * * *